United States Patent [19]

Karino

[11] Patent Number: 4,625,086

[45] Date of Patent: Nov. 25, 1986

[54] COOKING APPARATUS CAPABLE OF DISPLAYING THE RATIO OF ELAPSED COOKING TIME TO PRE-SET TIME

[75] Inventor: Hisao Karino, Nagoya, Japan

[73] Assignee: Kabushiki Kaisha Toshiba, Kawasaki, Japan

[21] Appl. No.: 737,450

[22] Filed: May 24, 1985

[30] Foreign Application Priority Data

May 29, 1984 [JP] Japan ..... 59-108806

[51] Int. Cl.[4] ..... H05B 6/68

[52] U.S. Cl. ..... 219/10.55 B; 219/506; 219/10.55 R; 99/325; 340/722

[58] Field of Search ..... 219/10.55 B, 10.55 R, 219/506; 99/325, DIG. 14; 340/711, 712, 713, 722

[56] References Cited

U.S. PATENT DOCUMENTS

| | | | |
|---|---|---|---|
| 4,169,222 | 9/1979 | Tucker | 219/506 X |
| 4,328,408 | 5/1982 | Lawson | 219/506 X |
| 4,399,352 | 8/1983 | Ueda | 219/10.55 B |
| 4,410,795 | 10/1983 | Ueda | 219/506 X |

FOREIGN PATENT DOCUMENTS

| | | |
|---|---|---|
| 0027711 | 4/1981 | European Pat. Off. . |
| 0056335 | 7/1982 | European Pat. Off. . |
| 3118825 | 2/1982 | Fed. Rep. of Germany . |
| 55-805 | 1/1980 | Japan . |
| 57-187534 | 11/1982 | Japan . |
| 1569516 | 6/1980 | United Kingdom . |

*Primary Examiner*—Philip H. Leung

*Attorney, Agent, or Firm*—Cushman, Darby & Cushman

[57] ABSTRACT

A cooking apparatus has a heating chamber having a plurality of heating functions so as to cook food in accordance with a plurality of cooking modes, cooking information settings for setting at least one of the cooking modes and cooking information including a cooking time, a cooking information display having a display element for performing graphic display of at least time elapsed information of the cooking information in accordance with a plurality of colors respectively corresponding to the plurality of cooking modes, a first control component for designating a given heating function in the heating chamber in accordance with the set cooking information and controlling at least a cooking drive time required for the given heating function, and second control component for calculating the time for elapsed information to drive at least the graphic display element in the cooking information display component and for designating a color for the time elapsed information in accordance with a type of cooking mode.

9 Claims, 8 Drawing Figures

COOKING APPARATUS CAPABLE OF DISPLAYING THE RATIO OF ELAPSED COOKING TIME TO PRE-SET TIME

BACKGROUND OF THE INVENTION

This invention relates to a cooking apparatus and, more particularly, to an improvement of the display device of a cooking apparatus having a plurality of cooking modes.

A conventional cooking apparatus is known wherein food can be heated or cooked in a heating chamber of a housing in accordance with a plurality of heating functions such as an oven function, a grill function and a microwave range oven function.

In a cooking apparatus of this type, a digital display device, for example, is usually arranged in an operation panel adjacent to a front door of the heating chamber in the housing to digitally display, for example, remaining cooking time on the display device during cooking. In this case, a cooking set time is digitally displayed at the beginning of cooking. The display contents are decremented every one second as the time elapses. When the food is cooked, the display content is zero.

In the conventional arrangement described above, a user cannot check a cooking state at a desired moment in order to know how many minutes of the total preset time have elapsed, resulting in inconvenience. In addition, when a user wishes to perform sequential cooking of food by combining, e.g., the microwave oven range function and the oven or grill function, the user cannot check at once how many minutes of the total preset time have elapsed, resulting in inconvenience.

SUMMARY OF THE INVENTION

It is, therefore, an object of the present invention to provide a new and improved cooking apparatus in which effective display operations are performed so that a user can immediately check at a desired moment how many minutes have elapsed in a single cooking mode selected among a plurality of cooking modes, and can also immediately check at a desired moment how many minutes of the total cooking time have elapsed when a plurality of cooking modes are continuously performed in combination during sequential cooking, and also can easily identify each cooking mode.

According to the present invention, a cooking apparatus comprises:

- a heating chamber having a plurality of heating functions so as to cook food in accordance with a plurality of cooking modes;
- cooking information setting means for setting at least one of the cooking modes and cooking information including a cooking time;
- cooking information displaying means having a display element for performing graphic display of at least time elapsed information of the set cooking information in accordance with a plurality of colors respectively corresponding to the plurality of cooking modes;
- first control means for designating a given heating function in the heating chamber in accordance with the set cooking information and for controlling at least a cooking drive time required for the given heating function; and
- second control means for calculating the time elapsed information to drive at least the graphic display element in the cooking information display means and for designating a color for the time elapsed information in accordance with the type of cooking mode.

BRIEF DESCRIPTION OF THE DRAWINGS

These and other objects and features of the present invention can be understood by reference to the accompanying drawings, in which.

DETAILED DESCRIPTION OF THE PREFERRED EMBODIMENT

Figure 1:
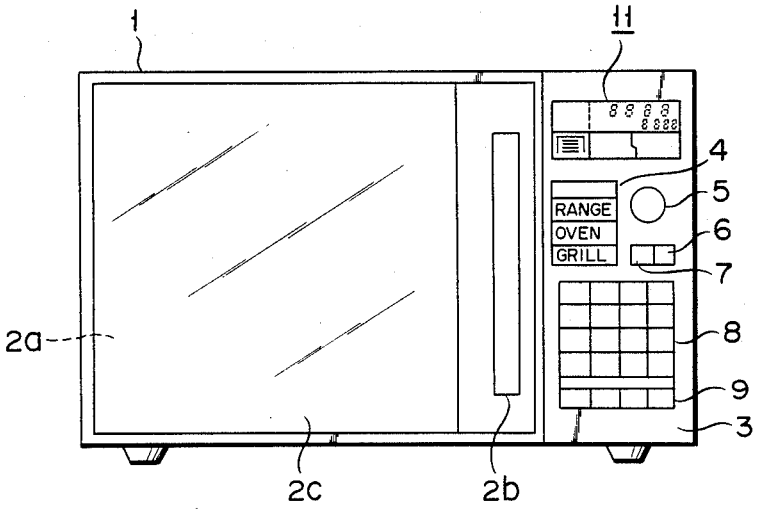
FIG. 1 is a front view of a cooking apparatus according to an embodiment of the present invention.

FIG. 1 is a front view of a cooking apparatus, with a plurality of cooking functions, as a so-called oven/grill (electronic) range according to an embodiment of the present invention. A housing 1 comprises a heating chamber 2*a* having a plurality of heating functions corresponding to a plurality of cooking modes such as an oven function, a grill function and a microwave oven range function, and a door 2*c* held by a handle 2*b* to close/open the heating chamber 2*a*. An operation panel 3 is arranged in the right portion of the housing 1.

In addition to a display device 11 (to be described later), the operation panel 3 has a plurality of cooking mode selection keys 4, a timer dial 5, a cooking start key 6, a cooking stop key 7, a plurality of cooking item keys 8, and cooking temperature keys 9 arranged from the upper portion to the lower portion thereof.

Figure 2:
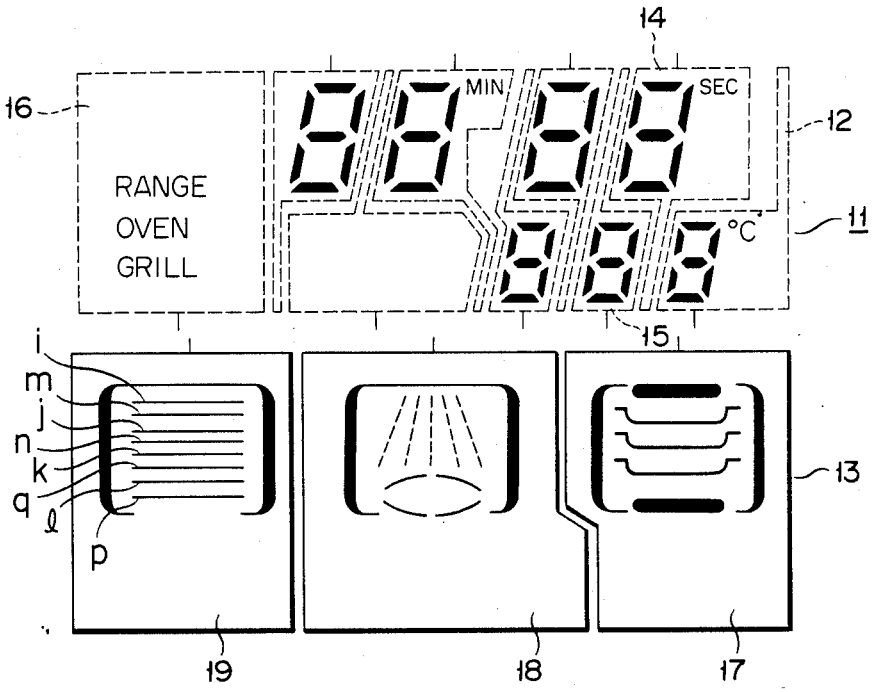
FIG. 2 is a detailed view of a display device of FIG. 1.

FIG. 2 shows a detailed arrangement of the display device 11. The device 11 comprises a first display section 12 and a second display section 13. The section 12 has digital display units 14 and 15 for digitally displaying cooking information such as a preset cooking time, a remaining cooking time and a cooking temperature, and a cooking mode display unit 16 for displaying a cooking mode with letters such as "OVEN", "GRILL" and "RANGE". The section 13 comprises graphic display units for displaying different cooking modes by corresponding illustrations. More particularly, the section 13 has a tray position display unit 17 for displaying a cooking tray position in the heating chamber, a microwave oven range cooking state display unit 18 for displaying a microwave oven range cooking state and a bar display unit 19 for displaying a type of cooking mode and an elapsed cooking time, i.e., a cooking state. Eight indicator bars (display elements) i, m, j, n, k, Q, l and p made of fluorescent lamps or light-emitting diodes are vertically arrayed parallel to each other. Among the bars i to p, the bars i, j, k and l are constituted by red segments for emitting red light, and the bars m, n, Q and p are constituted by green segments for emitting green light. The red and green segments are alternately arranged along the vertical direction.

Figure 3:
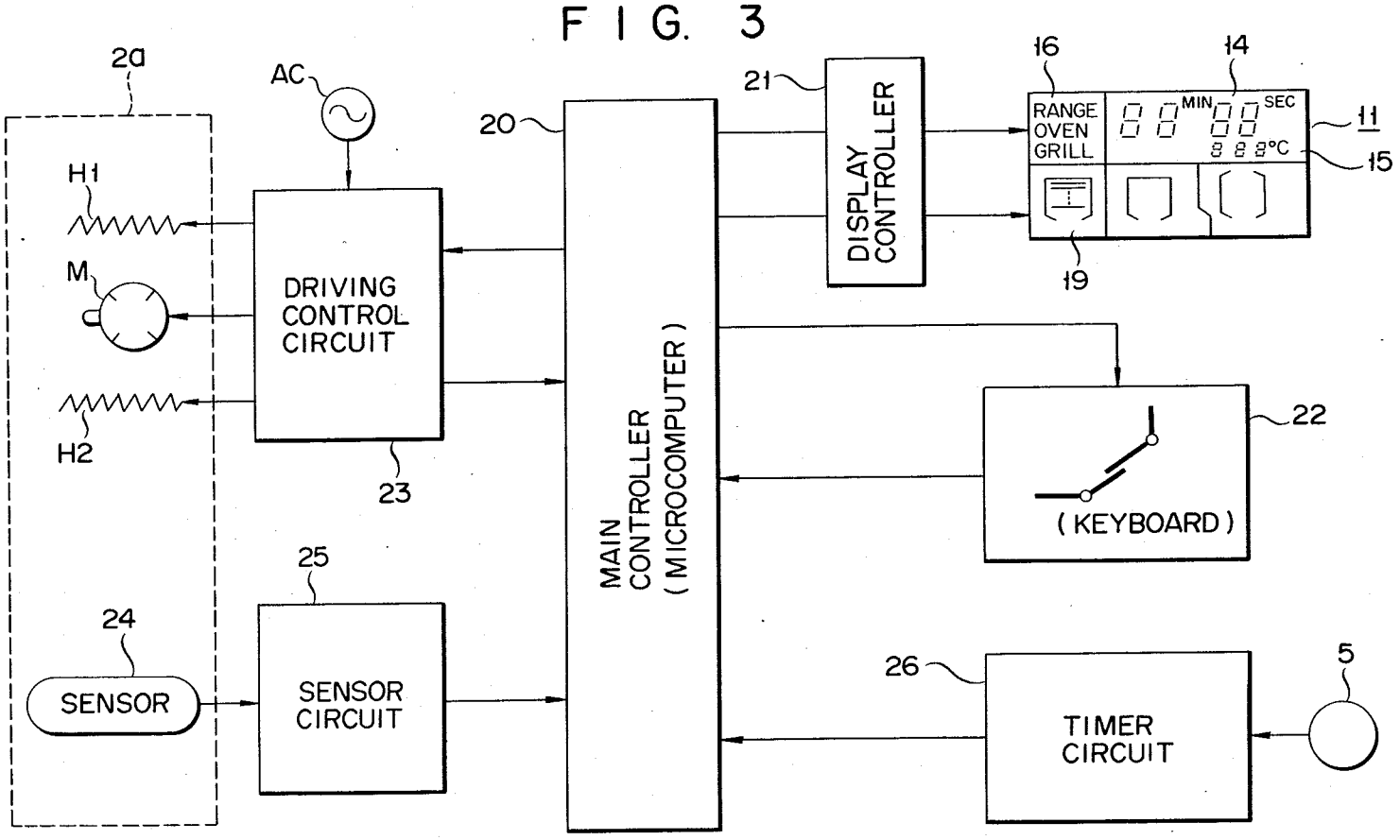
FIG. 3 is a block diagram of a control circuit of the apparatus shown in FIG. 1.

FIG. 3 shows a control circuit built into the housing 1. A main controller 20 comprises a microcomputer having an internal memory for storing a program for predetermined control (to be described later). The controller 20 is connected to the device 11 through a display controller 21 including a decoder function. A segment signal and a digit signal are supplied from the controller 20 to the device 11 through the controller 21, and the device 11 is turned on or off in accordance with control (to be described later) of a combination of the segment and digit signals. In this case, the controller 21 causes the device 11 to display data "0000" to alarm a power failure. A keyboard (matrix switch pad) 22 including the various keys on the operation panel 3 (FIG. 1) of the housing 1 is connected to the controller 20. The keyboard 22 receives the digit signal from the controller 20. A key input signal corresponding to a predetermined keying operation is supplied from the keyboard 22 to the controller 20. The controller 20 is also connected to a driving control circuit 23 for controlling the oscillation of a microwave oven range function magnetron M and the ON/OFF operation of upper and lower heaters H1 and H2 respectively serving as the oven and grill function heaters. In response to the key input signal from the keyboard 22, the controller 20 sets the corresponding cooking mode. When the key 6 is turned on after the cooking time is preset, the controller 20 causes the units 14 and 15 in the device 11 to display numerical data such as the preset cooking time, the remaining cooking time and the cooking temperature. The controller 20 also causes the unit 16 to display letters corresponding to the selected heating function. When the cooking time gradually elapses, the ON/OFF states of the bars i to p in the unit 19 are sequentially updated, thereby signalling to the user that the elapsed time corresponds to the number of ON bars among the bars i to p. In addition, when sequential cooking is performed wherein heating and cooking are performed in a combination of a plurality of heating functions, the elapsed time with respect to the total preset time is indicated so that the display color in the unit 19 is changed every time the heating function is changed.

The controller 20 is connected through a sensor circuit 25 to a sensor 24 arranged at a predetermined position in the heating chamber 2*a* in the housing 1 so as to detect the temperature. The controller 20 is also connected to a timer circuit 26 for receiving the time information set by the dial 5 arranged on the panel 3 in the housing 1.

The controller 20 and the circuit 23 control an output level of the magnetron M in predetermined steps upon operation of a magnetron output level selection key (not shown). The controller 20 and the circuit 23 cooperate with the sensor 24 and the sensor circuit 25 to control heat radiated from the heater H1 (in the grill function mode) or the heaters H1 and H2 (in the oven function mode).

The operation of the microwave oven range having the arrangement described above will be described hereinafter. When the user enters the type of heating function, the cooking time, and the cooking temperature at the keyboard 22 and with the dial 5, a key input signal corresponding to the operation of the keyboard 22 is directly supplied to the main controller 20 and the time set signal is supplied thereto through the timer circuit 26. The signals received by the controller 20 are supplied to the device 11 through the controller 21. The heating function, the cooking time and the cooking temperature are digitally displayed on the units 16, 14 and 15, respectively. In this state, when the key 6 is turned on, the circuit 23 is controlled on the basis of the heating information (i.e., the type of heating function, the preset cooking time and the cooking temperature) received by the controller 20, and the magnetron M, the heater H1 or heaters H1 and H2 are driven by the circuit 23. When the preset cooking time gradually decreases, the cooking time display at the unit 14 is decremented every one second. When the heating function selected is, for example, the microwave oven range function, the green bar p in the unit 19 is turned on at the beginning of cooking. Thereafter, when the controller 20 determines that a period which is $\frac{1}{4}$ of the total cooking time has elapsed, the bars p and Q are simultaneously turned on. When the controller 20 determines that a period which is 2/4 of the total cooking time has elapsed, the bars p, Q and n are turned on. When periods which are $\frac{3}{4}$ and 4/4 of the total cooking time have elapsed, the bars p, Q and n and the bars p, Q, n and m are turned on, respectively. When the controller 20 determines that cooking is completed, the controller 20 causes the unit 14 to display zero cooking time. At the same time, the controller 20 controls the unit 19 to turn off all the bars in the unit 19. When the heating function is the oven function or the grill function, the red bars l, k, j and i are sequentially turned on as the actual cooking time increases. The green bars p, Q, n and m are kept OFF. When cooking is completed, the controller 20 causes the bars p to i to turn off. The ON/OFF operation of the bars is reversed when the heating function is the microwave oven range.

Figure 4:
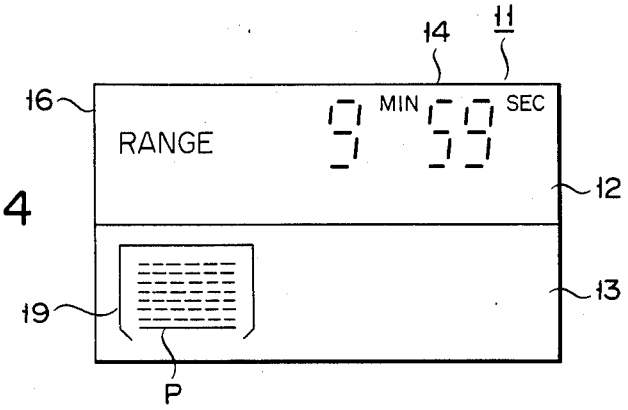
FIGS. 4 to 8 are respectively representations showing display states of the display device so as to explain the operation of the apparatus shown in FIG. 1.
Figure 5:
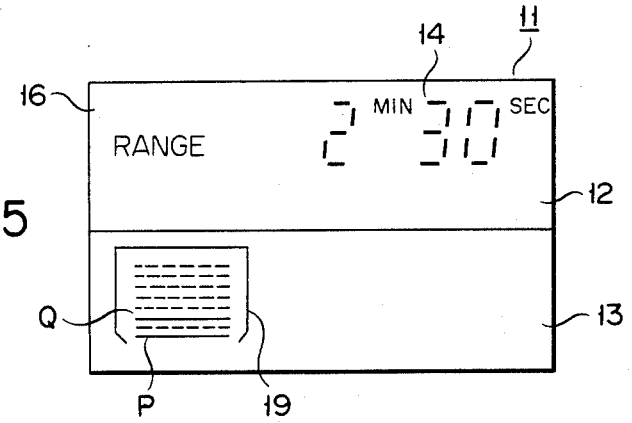
Figure 6:
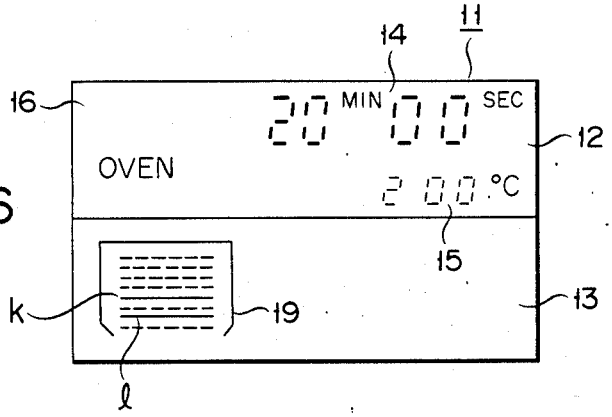
Figure 7:
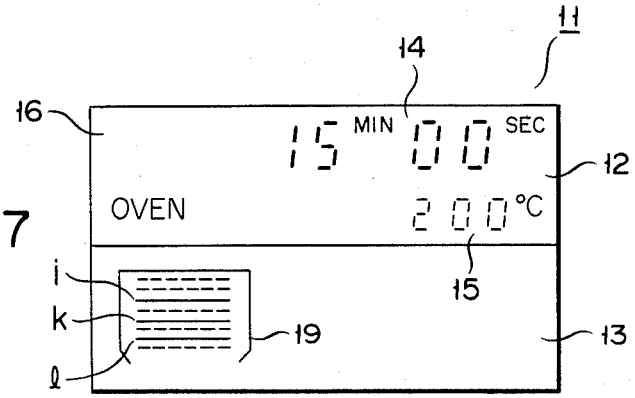
Figure 8:
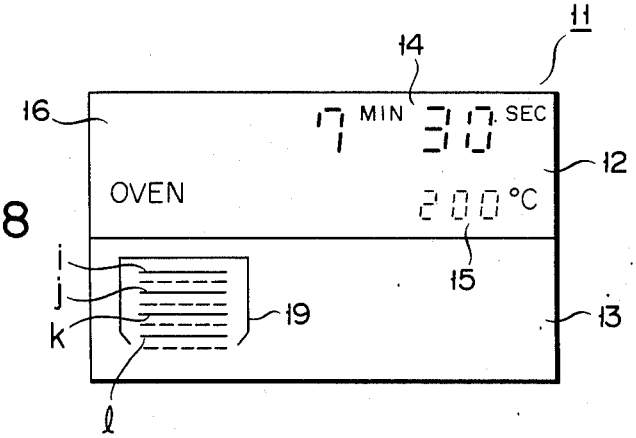

Assume that sequential cooking (two-mode cooking) is performed so that food is cooked in the microwave oven range function for 10 minutes and is then heated in the oven function (or the grill function) for 20 minutes, thereby continuously cooking the food for a total time of 30 minutes. The controller 20 controls so that the microwave oven range function "RANGE" is displayed on the unit 16 in the device 11. At the same time, the preset cooking time (i.e., 10 minutes) in the microwave oven range function is digitally displayed on the unit 14. When the key 6 is turned on, the content of the cooking time displayed on the unit 14 is controlled so as to be decremented every one second in accordance with time control and arithmetic operation of the controller 20. The controller 20 also controls to turn on only the green bar p of the unit 19, as shown in FIG. 4, immediately after cooking is started (e.g., when the remaining time is about 9 minutes and 59 seconds in the microwave oven range function). When the remaining cooking time is two minutes and 30 seconds in the microwave oven range function, and the controller 20 determines that $\frac{1}{4}$ of the total cooking time is remaining, the controller 20 causes the bars p and Q in the unit 19 to turn on, as shown in FIG. 5. When the controller 20 switches the microwave oven range function to the oven function after the controller 20 has determined that 10 minutes have elapsed, the oven function "OVEN" is displayed on the display 16, and the preset cooking time (i.e., 20 minutes in the oven function mode) is digitally displayed on the unit 14, as shown in FIG. 6. The controller 20 then turns off the green bars p and Q in the unit 19, and then the red bars l and k are turned on. In this state, cooking in the oven function mode continues. When the remaining time of the oven function cooking is 15 minutes and the controller 20 determines that the total elapsed time is 2/4 of the total cooking time in the sequential cooking mode, the controller 20 turns on the red bars l, k and j in the unit 19. When the controller 20 determines that the remaining time of the oven function mode is 7 minutes and 30 seconds, and that the total elapsed time of sequential cooking is $\frac{3}{4}$, the red bars l, k, j and i in the unit 19 are turned on. When the controller 20 determines that the oven function time is zero and sequential cooking is completed, the controller 20 causes all the bars p to i to turn off.

In the microwave oven range with the above operation, when single heating cooking (i.e., single mode cooking) is performed, the number of bars turned on in the unit 19 is changed. More specifically, when the microwave oven range function is performed, the main controller controls to sequentially turn on the green bars p, Q, n and m. When the oven or grill function is performed, the main controller controls to sequentially turn on the red bars l, k, j and i. At any moment during cooking, the user can check the cooking state (i.e., the elapsed time of the total cooking time) by visually observing the number of bars turned on. In addition, by visually checking the color of the bars turned on, the user can easily know the type of heating function. Similarly, when sequential cooking (cooking by a plurality of modes) is performed, the elapsed time of the total cooking time can be recognized by visually checking the number of bars turned on among the bars p to i. Therefore, the cooking state can be easily checked. In addition, by checking the color of the bars turned on, the current heating function can be easily identified.

The present invention is not limited to the particular embodiment described above. For example, the unit 19 may comprise a liquid crystal display panel. The display elements are not limited to the linear display bars p to i. The display bars may be replaced with a circular display unit. In this case, a plurality of fan-shaped display elements are arranged adjacent to each other within the circular display unit. Various other changes and modifications may be made within the spirit and scope of the invention.

According to the present invention, by arranging a plurality of parallel display elements in the display unit, the number of display elements turned on is sequentially changed to indicate the elapsed time of the total cooking time. At the same time, in sequential cooking for continuous cooking by a plurality of heating functions, the ON/OFF states of the display elements are sequentially changed to indicate the elapsed time of the total cooking time of sequential cooking. The display color in the display device changes every time the heating function is changed. Therefore, the elapsed time of the total cooking time at any moment during cooking and the elapsed time of the total cooking time of sequential cooking can be immediately observed and visually checked. The type of cooking function can be easily confirmed to improve operability.

What is claimed is:

1. A cooking apparatus comprising:

a heating chamber having a means for thermal heating and a means for microwave heating;

cooking mode selecting means for selecting a cooking mode, said cooking mode including, a thermal heating mode for cooking by said thermal heating means, a microwave heating mode for cooking by said microwave heating means, and a first sequential heating mode for cooking by both said thermal heating means and said microwave heating means;

cooking time setting means for setting at least one cooking time for said thermal heating mode, for said microwave heating mode and for said first sequential heating mode;

display means for displaying the ratio of elapsed time of said cooking time to said time set for said cooking mode, including, a first group of display elements of a first color for displaying the ratio of elapsed time of said cooking time for said microwave heating mode, to said time set for said microwave heating mode, and a second group of display elements of a second color for displaying the ratio of elapsed time of said cooking time set for said thermal heating mode, to said time set for said thermal heating mode, said second color being different from said first color first control means for generating a heating control signal when said heating mode is selected by said cooking mode selecting means and said time set by said cooking time setting means, said first control means supplying the heating control signal to at least one of said thermal and microwave heating means; and second control means for calculating the ratio of said elapsed cooking time to said time set by said cooking time setting means, and for generating a display control signal in accordance with said calculated ratio, said second control means supplying said display control signal to at least one of said first and second groups of display elements.

2. A cooking apparatus according to claim 1, wherein:

said thermal heating means includes, an oven-functioning means; and said cooking mode includes at least one of the following: an oven mode for cooking by said oven-functioning means, and a second sequential heating mode which is a combination of said oven mode and said microwave heating mode.

3. A cooking apparatus according to claim 1, wherein:

said thermal heating means includes an oven-functioning means and a grilling means;

said cooking mode includes at least one of the following: an oven mode for cooking by said oven-functioning means, a grilling mode for cooking by said grilling means and a third sequential heating mode which is at least one of a combination of said oven mode and said microwave heating mode, and said grilling mode and said microwave heating mode; and said cooking time setting means for setting at least one cooking time for said oven mode, said grilling mode and said third sequential heating mode.

4. A cooking apparatus according to claim 3, wherein said first group of display elements displays said ratio of said elapsed cooking time for said microwave heating mode to said time set for said microwave heating mode, and said second group of display elements displays the ratio of elapsed cooking time for said oven mode to said time set for said oven mode and the ratio of elapsed cooking time for said grilling mode to said time set for said grilling mode.

5. A cooking apparatus according to claim 1, wherein said first group of display elements and said second group of display elements are bar-shaped and alternately arranged.

6. A cooking apparatus according to claim 5, wherein said display elements are fluorescent display tubes.

7. A cooking apparatus according to claim 5, wherein said display elements are light-emitting diodes.

8. A cooking apparatus according to claim 1, wherein said display control signal sequentially drives at least one of said first and second groups of display elements as said ratio calculated by said second control means increases by a predetermined value and stops driving all of said display elements upon lapse of said time set by said cooking time setting means.

9. A cooking apparatus according to claim 8, wherein said predetermined value is one-fourth of the time set by said cooking time setting means.

* * * * *